US005206841A

United States Patent [19]

Boucheron

[11] Patent Number: 5,206,841

[45] Date of Patent: Apr. 27, 1993

[54] WRISTWATCH WITH CASE HAVING AN INTERCHANGEABLE COVER

[75] Inventor: Alain Boucheron, Paris, France

[73] Assignee: Boucheron, Paris, France

[21] Appl. No.: 735,788

[22] Filed: Jul. 25, 1991

[30] Foreign Application Priority Data

Aug. 1, 1990 [FR] France ..... 90 09844

[51] Int. Cl.[5] ..... A44C 5/00; G04B 37/00

[52] U.S. Cl. ..... 368/276; 368/281; 368/283

[58] Field of Search ..... 368/276, 281-283, 368/286

[56] References Cited

U.S. PATENT DOCUMENTS

| | | | |
|---|---|---|---|
| 2,207,512 | 7/1940 | Guild | 58/88 |
| 2,636,338 | 4/1953 | Dinstman | 368/283 |
| 4,168,607 | 9/1979 | Friedman | 368/283 |
| 4,396,298 | 8/1983 | Ripley | 368/282 |
| 5,034,932 | 7/1991 | Grosjean | 368/283 |

FOREIGN PATENT DOCUMENTS

| | | |
|---|---|---|
| 082813 | 9/1983 | European Pat. Off. . |
| 280963 | 7/1988 | European Pat. Off. . |
| 1092554 | 4/1955 | France . |
| 273456 | 2/1951 | Switzerland . |
| 14031/63 | 5/1966 | Switzerland . |

*Primary Examiner*—Vit W. Miska

*Attorney, Agent, or Firm*—Beveridge, DeGrandi, Weilacher & Yound

[57] ABSTRACT

Wristwatch comprising a case (1) enclosing the watchmaking components and provided with a dial (10), a flexible strap (2) provided with rigid reinforcing elements (3) at the ends interacting with two opposite sides (5*a*, 5*b*) of the case, and a removable cover (4) mounted by slipping over the case (1), the cover being provided with a window (15) for the dial of the case and elastic locking components (16*a*, 16*b*) interacting with the case and the reinforcing elements (3) of the flexible strap (2) for mounting the cover on the case.

7 Claims, 2 Drawing Sheets

WRISTWATCH WITH CASE HAVING AN INTERCHANGEABLE COVER

The present invention relates to a wristwatch whose case has two opposite parallel sides provided with assembly means interacting in a removable manner with the reinforced ends of a flexible strap.

French Patent Application 90/03,277 discloses a wristwatch whose case has two bores on two opposite sides, the said bores each being provided with an axial slot. The flexible strap is reinforced at each end by means of a rigid element of substantially cylindrical outer form which interacts with a bore of the case in order to provide removable mounting of the strap on the case.

One of the direct results is the ease of changing the flexible strap for straps in different material and of different appearance so as to be able to vary the overall appearance of the wristwatch as desired.

The object of the present invention is to produce a wristwatch in which it is possible not only to change the appearance of the strap, but also the appearance of the case without any modification to the watchmaking components of the watch.

According to the invention, the wristwatch comprises a case enclosing the watchmaking components and provided with a dial, and a flexible strap with reinforced ends interacting with two opposite parallel sides of the case, and a removable cover mounted over the case and provided with a window through which the said dial can be seen. The cover is fixed to the case jointly by the case and the reinforced ends of the flexible strap.

According to a particular embodiment of the invention, the ends of the flexible strap are reinforced by rigid cylindrical elements. The opposite sides of the case are provided with bores in which the rigid elements reinforcing the strap slide for the assembling and dismantling of the strap and of the case. The cover has two locking components corresponding to two opposite sides of the case and interacting with the bores and the rigid reinforcing elements for fixing the cover on the case.

The invention will be better understood from a study of the detailed description of two embodiments taken by way of non-limiting example and illustrated by the appended drawings, in which.

Figure 1:
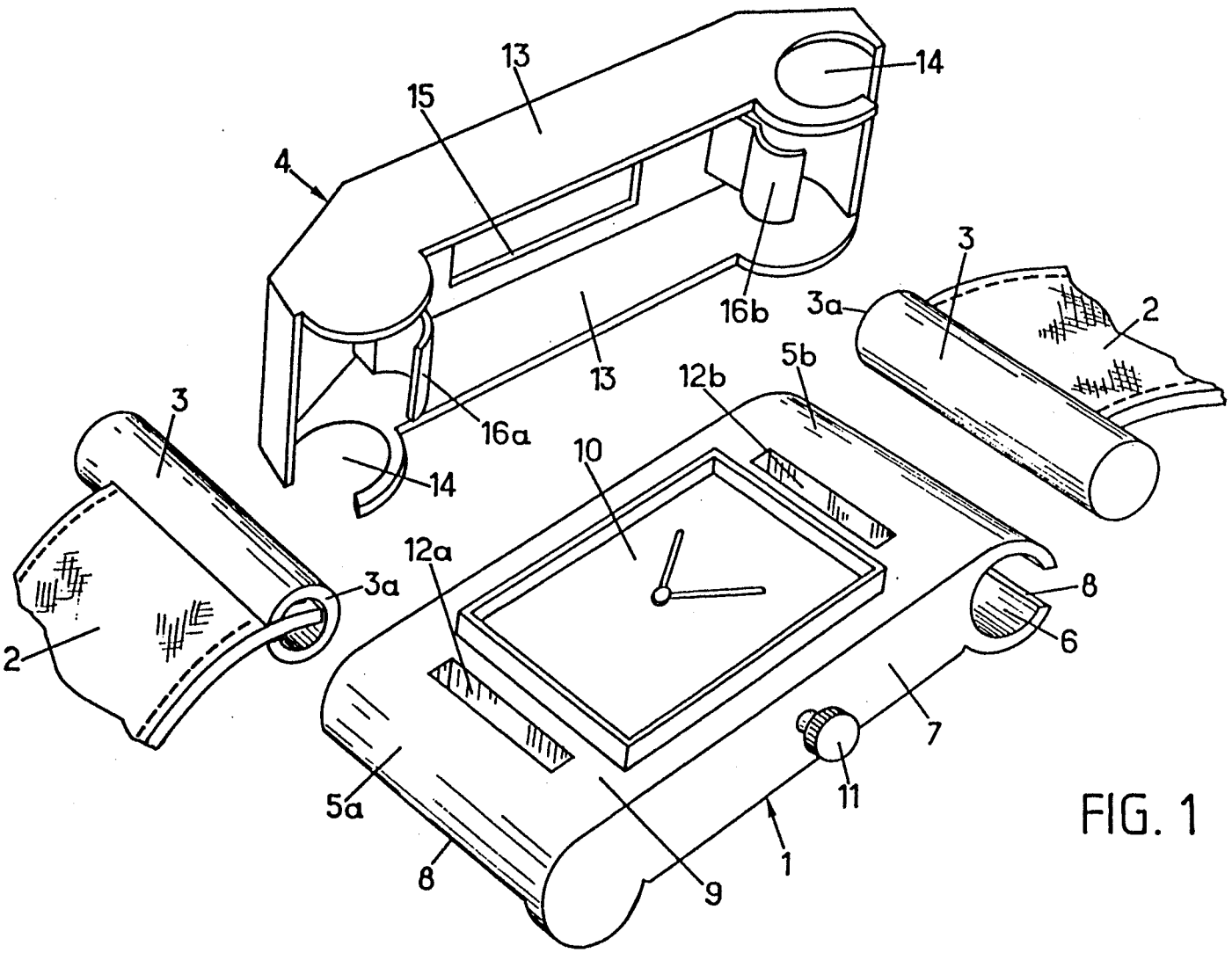
FIG. 1 is an exploded view of the wristwatch according to the invention.

As illustrated in FIG. 1, the wristwatch comprises a case 1, a flexible strap 2 with a rigid reinforcing element 3 at each end, and a cover 4 for the case 1.

The case 1 has a substantially parallelepipedal form with two opposite sides 5*a*, 5*b* of rounded form and each provided with a bore 6, each bore opening out into a lateral side 7 in a diametrically opposed manner on the case 1. Each bore 6 has a straight slot 8 passing through the wall longitudinally with respect to the bore 6. The bore 6 has a substantially circular section and receives a rigid reinforcing element 3 for the flexible strap 2 with a view to assembling the strap 2 on the case 1.

The reinforcing element 3 is fixed to the corresponding free end of the strap 2 and has a substantially cylindrical outer form. The strap 2 is assembled on the case 1 by inserting an end 3*a* of the reinforcing element 3 into the opening of the corresponding bore 6 located on the lateral side 7 of the case 1. The straight slot 8 permits the passage of the strap 2 during the translational movement of the reinforcing element 3 in the bore 6 and during the use of the wristwatch after mounting of the strap 2 on the case 1.

On the upper face 9 of the case 1 there is a raised dial 10 of the watch. All the watchmaking components are enclosed in the case 1 which is also provided with a winding mechanism 11 on a lateral side 7, in particular for hand setting the dial 10. The winding mechanism 11 may project laterally relative to the side 7 or be delimited by the plane of the lateral side 7, in which case the case 1 has an opening (not shown) on the upper face 9 in order to permit the manual operation of the winding mechanism 11. The case 1 also has two passages 12*a*, 12*b* located in the vicinity of the opposite sides 5*a*, 5*b* and establishing communication between the upper face 9 of the case and the inside of the bores 6.

The rigid cover 4 is preferably made from metallic materials and has a form corresponding substantially to that of the case 1. The lateral sides 13 of the cover 4 are spaced apart by a distance which is greater than or equal to that of the case 1 so as to be able to enclose the case and the winding mechanism 11. The cover 4 also has two openings 14 on the lateral sides 13 corresponding to the openings in the bores 6 of the case 1. A window 15 which can allow the raised dial 10 of the case 1 to pass when the cover is assembled on the case is made on the upper side of the cover 4.

Two locking components 16*a*, 16*b*, for example in the form of elastic tabs, integral with the lower face of the upper side of the cover 4 are inserted into the corresponding passages 12*a*, 12*b* of the case 1 during assembly of the cover 4.

Figure 2:
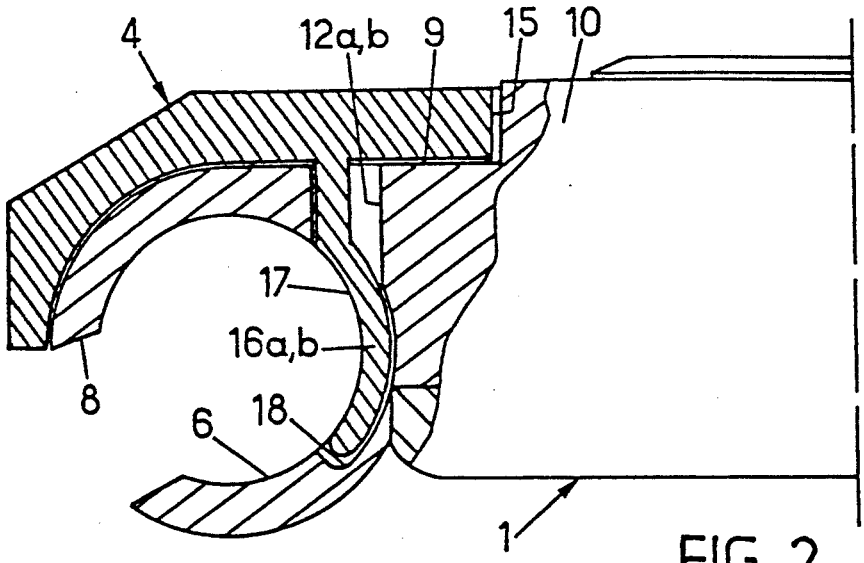
FIG. 2 is a cutaway view in partial section of the cover mounted on the case according to a first embodiment of the invention.

As may be seen from FIG. 2, the cover 4 in the assembled position is slipped over the upper face 9 of the case 1 with the window 15 around the dial 10. The tab 16*a*, 16*b* is in one piece with the cover 4 and has a curved end part whose inner face 17 has a vertical section in the form of an arc of a circle in order to ensure the surface continuity of the bore 6 once the tab 16*a*, 16*b* has been inserted via the passage 12*a*, 12*b* of the case. At the level of the bore 6, the case has a depression 18 extending the passage 12*a*, 12*b* so as to be able to accommodate the tab 16*a*, 16*b* of the cover in the assembled position.

Thus, the insertion of the tab 16*a*, 16*b* via the passages 12*a*, 12*b* of the case involves an elastic deformation of the tab, this deformation being offset by the depression 18 of the case when the cover 4 is in the assembled position. This results in the removal of the tab 16*a*, 16*b* via the passage 12*a*, 12*b* also requiring an elastic deformation of the said tab. This thus produces a clipping effect provided by the tabs 16*a*, 16*b* for assembling the cover 4 on the case 1.

It is possible to obtain the same clipping effect with the aid of supplementary means other than the tabs 16*a*, 16*b*. If the winding mechanism 11 does not project relative to the corresponding lateral side 7 of the case 1, provision may be made, for example, on each lateral side 7 of the case for one or more retractable studs (not shown) which interact with one or more corresponding hollows on the inner walls of the lateral sides 13 of the cover 4. In this case, the locking components 16*a*, 16*b* in the form of tabs do not need to be elastic. It then suffices to widen the passages 12*a*, 12*b* to permit the insertion without elastic deformation of the locking components 16*a*, 16*b* into the bores 6 of the case 1.

Figure 3:
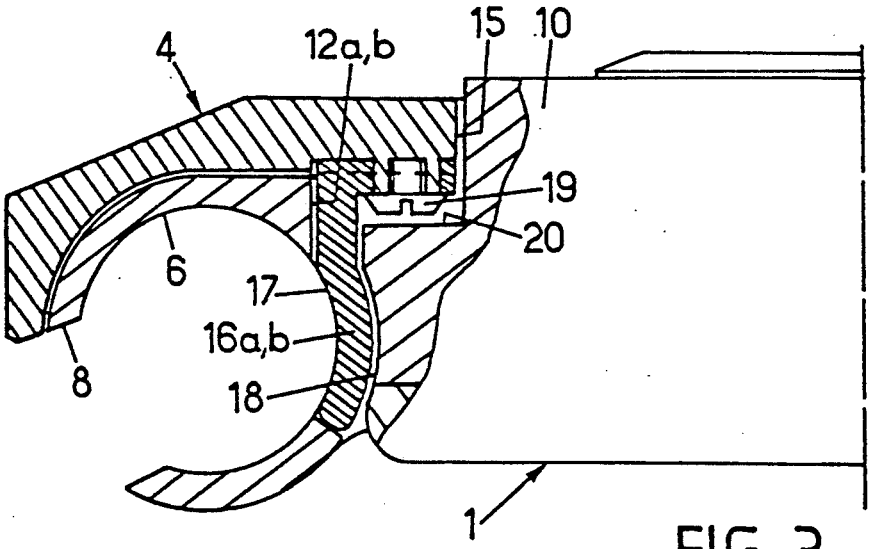
FIG. 3 is a cutaway view in partial section of the cover mounted on the case according to a second embodiment of the invention.
Figure 4:
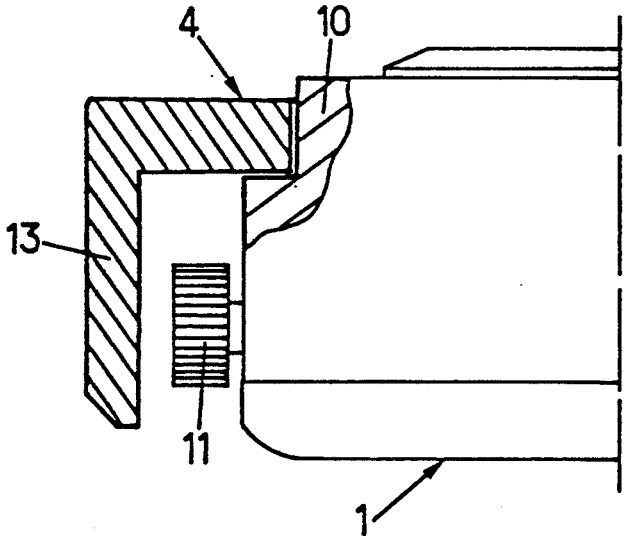
FIG. 4 is a cutaway view in partial section of the cover mounted on the case according to the invention.

FIG. 3 shows another alternative embodiment of the invention providing tabs 16*a*, 16*b* joined to the cover 4 with the aid of fixing screws 19. The upper face 9 of the case 1 is provided, in this case, with recesses 20 in the vicinity of the passages 12*a*, 12*b* which receive the fixing screws 19.

Assembling the wristwatch according to the invention consists, firstly, in assembling the cover 4 with the case 1, slipping the former over the latter, with the tabs 16*a*, 16*b* passing through the passages 12*a*, 12*b* of the case and arriving in the bores 6 of the case. The rigid reinforcing elements 3 for the strap 2 are then inserted via the side 3*a* into the bores 6 of the case through the openings 14 on the lateral sides 13 of the cover 4 in the assembled position, and the reinforcing elements 3 are accommodated inside the bores 6 of the case and ensure, at the same time, that the tabs 16*a*, 16*b* of the cover are held in the depressions 18 of the case 1 so as to prevent the removal of the said tabs and therefore the dismantling of the cover 4. The free end of the reinforcing elements 3 in the assembled position is flush with the lateral sides 13 of the cover 4 so as to form continuous surfaces.

Given that the winding mechanism 11 is enclosed by the cover 4 in the assembled position, it is firstly necessary to withdraw the reinforcing elements 3 from the bores 6 of the case and then the tabs 16*a*, 16*b* through the passages 12*a*, 12*b* of the case 1 so as to reveal the winding mechanism 11 of the case for hand setting the dial 10. This does not constitute a genuine constraint for the user, since the power source for the operation of the watchmaking components is not of a mechanical type.

According to the invention, the appearance of the wristwatch may be changed as desired by virtue of the interchangeability of the cover 4 and the interchangeability of the flexible strap 2.

I claim:

1. A wristwatch comprising:

a flexible strap provided with rigid reinforcing elements at both ends, a case with an enclosed watch module, said case having an upper surface which is provided with a dial and is delimited by two lateral sides and two opposite sides, with two bores near the opposite sides and opened at the lateral sides for receiving in a removable manner the reinforcing elements of the strap, said case having two passages between the upper surface of the case and the bores, a cover removably mounted by slipping over the case and provided with a window for the dial of the case, said cover including two integral locking components passing through the passages of the case and cooperating inside the bores of the case with the reinforcing elements of the strap to secure the cover on the case, the cover having lateral sides each provided with an opening for the entry of one of the reinforcing elements of the strap during its assembly with the case.

2. A wristwatch according to claim 1, wherein the locking components of the cover are tabs with curved inner surfaces, said bores having a curvature corresponding to that of said curved inner surfaces of the tabs.

3. A wristwatch according to claim 1, wherein the locking components of the cover are made in one piece with the cover.

4. A wristwatch according to claim 1, wherein the locking components of the cover are elastic.

5. A wristwatch according to claim 1, wherein the bores of the case include depressions for accommodating the locking components of the cover.

6. A wristwatch according to claim 1, wherein the dial of the case is raised relative to the upper surface of the

7. A wristwatch according to claim 1, wherein the case has a substantially parallelepipedal form with a winding mechanism on a lateral side, and the lateral sides of the cover are spaced from one another by a distance which is greater than or equal to that of the case so as to be able to enclose the case and the winding mechanism of the case.

* * * * *